United States Patent [19]

Wheeler

[11] Patent Number: 4,833,857

[45] Date of Patent: May 30, 1989

[54] SPACER MEMBER FOR REINFORCING STEEL

[76] Inventor: Charles F. Wheeler, 6141 NW. 34th Way, Fort Lauderdale, Fla. 33309-2221

[21] Appl. No.: 128,171

[22] Filed: Dec. 3, 1987

[51] Int. Cl.[4] ..... E04C 5/10

[52] U.S. Cl. ..... 52/687; 52/723; 264/35

[58] Field of Search ..... 52/722, 723, 687; 138/175; 264/228, 35

[56] References Cited

U.S. PATENT DOCUMENTS

| | | | |
|---|---|---|---|
| 354,892 | 12/1886 | DuBois | 52/687 |
| 849,922 | 4/1907 | Scofield | 52/687 |
| 1,008,210 | 11/1911 | Skinner | 52/687 X |
| 4,166,347 | 9/1979 | Pohlman et al. | 52/687 |
| 4,463,538 | 8/1984 | Dragunas | 52/677 |
| 4,489,528 | 12/1984 | Tolliver | 52/677 |

FOREIGN PATENT DOCUMENTS

| | | | |
|---|---|---|---|
| 280591 | 12/1930 | Italy | 52/687 |
| 0635205 | 11/1978 | U.S.S.R. | 52/687 |

*Primary Examiner*—Carl D. Friedman

*Attorney, Agent, or Firm*—Karen M. Gerken; Martin P. Hoffman; Mitchell B. Wasson

[57] ABSTRACT

A spacer member for positioning and retaining steel reinforcing bars in a concrete structural member such as a round-column. The spacer member is defined by a circular, ring-like main body section having a plurality of outer extensions and a plurality of interior projections. Each of the outer extensions has a remote edge adapted to abut the inner surface of a form for the structural member. Each of the interior projections is separated from next adjacent interior projections by a space, into which a reinforcing bar is intended to be inserted. The spaces are provided at least at every 45 degree and 60 degree intervals along the circle formed by the body member. The reinforcing bars are adapted to be securely tied in their respective spaces by means of securing means that is adapted to be wrapped around the bar and around a hook-like formation formed on the interior projection.

16 Claims, 2 Drawing Sheets

FIG. 1.
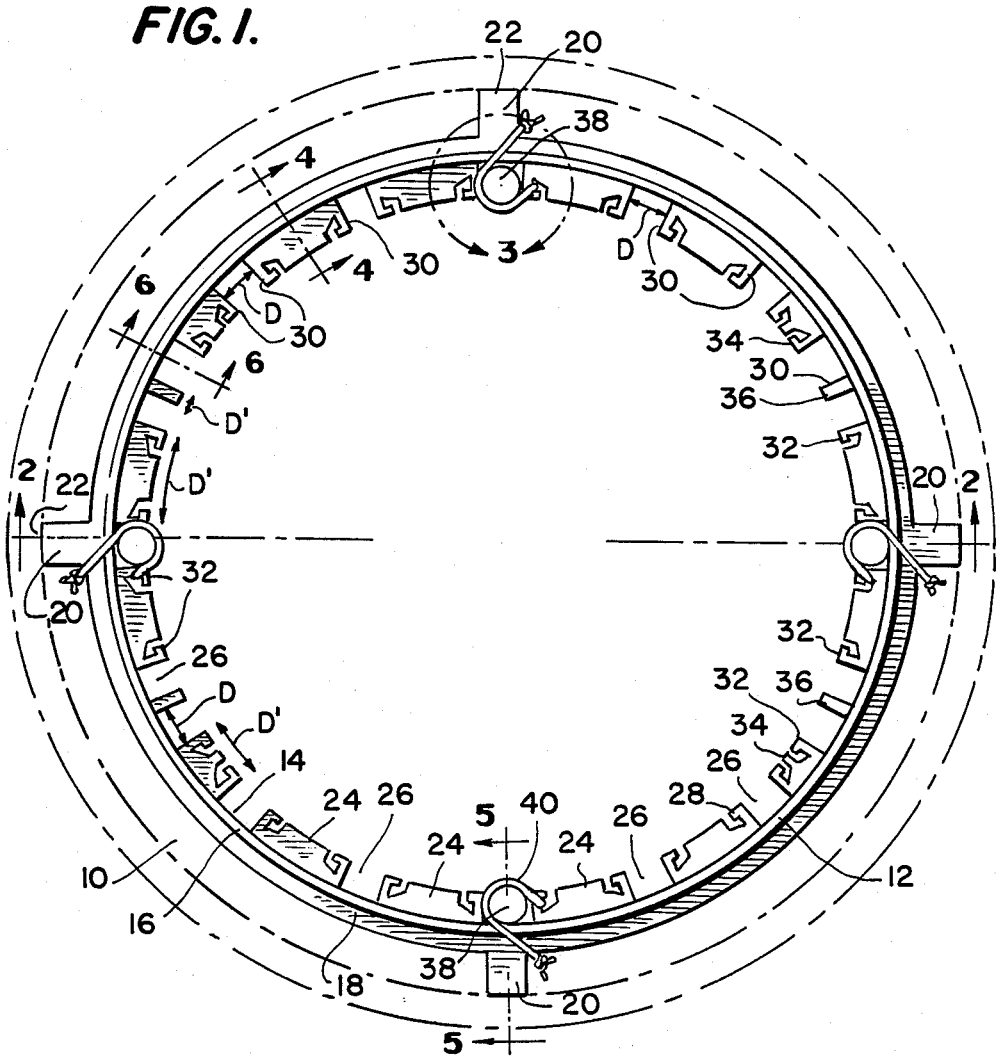
FIG. 2.
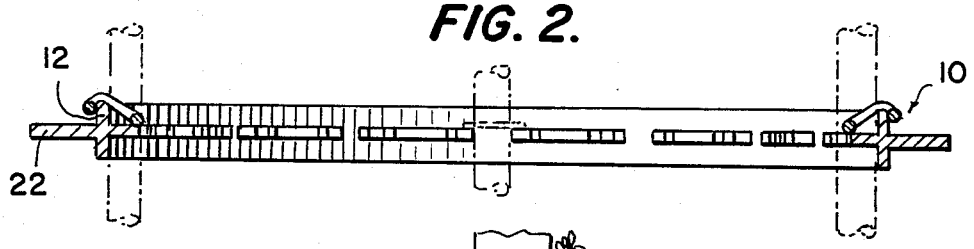
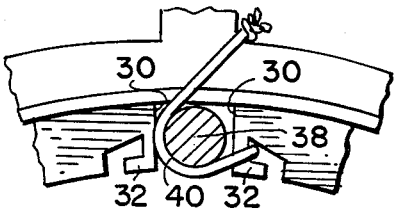
FIG. 3.

SPACER MEMBER FOR REINFORCING STEEL

CROSS REFERENCE TO RELATED PATENT APPLICATIONS

The subject matter of the invention herein disclosed and described is related to applicant's co-pending patent application Ser. No. 017,500, filed Feb. 24, 1987 and being directed to a steel placement member, and co-pending patent application Ser. No. 009,785, filed Feb. 2, 1987 and being directed to a support member for reinforcing steel.

CROSS REFERENCE TO RELATED PATENTS

The subject matter of the invention herein disclosed and described is related to applicant's U.S. Pat. No. 4,644,726, which issued on Feb. 24, 1987 on application Ser. No. 835,292, filed Mar. 3, 1986 and being directed to a steel placement assembly.

BACKGROUND OF THE INVENTION

1. Field of the Invention

The invention broadly pertains to a means for positioning, spacing and securing reinforcing steel in a concrete structural member.

More particularly, the invention is directed to a spacer member which is particularly adapted to effectively locate and restrain reinforcing steel bars in a concrete structural member having a generally circular cross-section, such as a round or circular column. The spacer member is specifically and uniquely adapted to accommodate a variety of design requirements and specifications, being suited for locating the requisite number and size of steel bars at the requisite locations in a particular structural member. When supported by means of the subject spacer member as contemplated by the invention, the reinforcing bars are positively restrained from undesirable shifting which is apt to occur with conventional devices during placement of the concrete.

A critical element of reinforced concrete design involves the accurate placement and support of the reinforcing bars in the concrete structural member. It is essential that the reinforcing steel be precisely located and supported the required distance inside the face of the concrete. Failure to maintain the reinforcing steel a sufficient distance, generally 1½ inches, inward of the face of the concrete results in detrimental oxidation of the steel reinforcement, thereby significantly compromising the integrity of the structural member and necessitating exceedingly costly and extensive restoration of the structure. The support member of the instant invention addresses and eradicates the normally prevalent problem of oxidation associated with reinforced concrete members by insuring accurate location of the steel reinforcement the optimum distance inside the face of the concrete.

The detrimental effects of oxidation can only be entirely prevented when the reinforcing steel is not only accurately positioned inside the concrete face, but when the reinforcing steel is also restrained from axial, transverse and rotational movement during placement of the concrete, so as to prevent unwanted shifting of the steel from its required position. The spacer member of the present invention is uniquely capable of obtaining effective and consistent placement of the steel the necessary distance inside the face of the concrete and of maintaining the steel in its allocated position.

Moreover, insuring the integrity of a concrete structural member demands that the reinforcing steel bars be successfully and reliably locked in position within the concrete form with respect to each other and prohibited from shifting from the latter positions when the concrete is placed. The number of and spacing for the reinforcing bars in a particular structural member varies according to diverse engineering factors such as wind load, snow load, etc. The subject support member positively prevents undesirable and potentially damaging movement of the reinforcing steel from the design parameters established for the structural member, thereby enhancing the structural integrity of the concrete member. Consequently, the design efficiency of architects and engineers for concrete structural members in enhanced, while the potential liability for the technical designer is substantially reduced. Additionally, the attributes in design and placement of reinforcing steel realized with the present spacer member result in lower costs of construction and maintenace for reinforced concrete structures.

A further significant feature of the invention involves its impressive ease of utilization in the field by relatively unskilled personnel. Prior art methods and devices for locating reinforcing steel in round columns have proved to be unsatisfactory due to the great difficulty, unreliability and complexity associated with their use. As a result, the latter devices are problematic for many reasons, including inaccuracies and deficiencies in assembly resulting in improper positioning of the steel reinforcing bars within the form. The subject invention, in contrast, is not only simple to utilize, but also provides a continually reliable means for assuring precise positioning of the reinforcing steel.

The foregoing features are realized with the instant invention by presenting a spacer member for reinforcing steel bars, which spacer member lends itself for implementation in locating and securing steel reinforcing bars the required distance inward of the concrete form and, hence, the outside face of the concrete. Furthermore, the spacer member provides means for spacing the steel bars with respect to each other within the concrete form. The invention is advantageous for its unprecedented reliability, feasibility, simplicity and economy, and is adapted to be formed so as to accommodate a variety of sizes and spacing schemes for the reinforcing steel in accordance with diverse technical specifications.

2. Description of the Prior Art

It is known in the prior art to provide reinforcing means in a generally cylindrical concrete structural member, such as a column. For example, U.S. Pat. No. 1,085,042 to Hickson discloses a post member wherein are located reinforcing rings connected by upright ties. Similarly, U.S. Pat. No. 1,412,096 to Von Emperger shows a compression member comprising a tube surrounded by an envelope of hooped concrete having helical windings and longitudinal reinforcing bars.

The prior art further teaches means for spacing and positioning longitudinal members in a generally vertical cylindrical structural member. An example of the latter teaching is disclosed in U.S. Pat. No. 1,248,049 to Wunder. Wunder teaches a column plate which is adapted to be provided at the top of a column for holding, among other things, column rods, service pipes and water pipes.

Means for spacing and locating vertical reinforcing bars in a round concrete column are also known in the prior art. For instance, U.S. Pat. No. 1,699,736 illustrates a spacer member in the form of a "spider", and including a plurality of prongs which project radially from annular hollow frame portions, and a plurality of circular cavities for receiving steel reinforcing bars. The bars are adapted to be retained within the cavities of means of lugs, which are located on each side of each cavity, being bent together around the respective rod.

U.S. Pat. No. 3,292,334 to Stöber similarly discloses a wheel-like spacer member including a rim and a hub, with reinforcing rods adapted to be received in gaps defined by the respective member.

Finally, U.S. Pat. No. 1,817,437 to Hawkinson discloses a spacer for a reinforced concrete pole comprising a plurality of flat triangular-shaped pieces of metal, each having long lugs adapted to be wrapped around a helical wrapping wire 2. Additional lugs disposed between the long lugs are provided to be bent into engagement with a reinforcing rod. The helical wrapping and the reinforcing rods are intended to be fastened together by lighter wire.

It is apparent from the foregoing that the prior art fails to teach or suggest a unitary spacer member which is able to accommodate a range of design parameters, and which is highly and consistently accurate, reliable and easy in its assembly and use as contemplated by the instant invention.

SUMMARY OF THE INVENTION

The present invention is directed to a spacer member for locating, positioning and securing steel reinforcing bars within a concrete structural member and, in particular, within a concrete column having a circular cross-section. The invention is specifically drawn to realizing accurate and consistent spacing of the steel reinforcing bars in conformance with design specifications, insuring proper placement of the steel bars with respect to the face of the concrete, effectively preventing shifting of the steel reinforcing bars while the concrete is being placed, and providing an efficient and easy means for precise reinforcement placement in the field by relatively unskilled personnel.

The spacer member comprises a generally circular, ring-like body member that has a vertical interior surface and a vertical exterior surface. The vertical exterior surface has a plurality of outer extensions projecting perpendicularly therefrom. Each of the extensions is provided with a remote edge adapted to abut the inner surface of a form for the concrete member when the spacer is disposed therein prior to placing of the concrete. The size of the outer extensions is such that the distance measured from the remote edge of each outer extension to the vertical interior surface of the body member is large enough to insure that the reinforcing bars placed within the spacer, as well as any hoop steel which may be tied around the bars, is located at least 1½ inches inside the inner surface of the form and, hence, 1½ inches inside the face of the concrete.

The vertical interior surface of the main body member is provided with a plurality of interior projections, extending perpendicularly from the vertical interior surface. Each of these projections has a pair of side edges, and is separated from adjacent interior projections by a space along the interior vertical wall. The interior projections are arranged on the interior vertical wall such that a space is located at least at every 45 degrees and every 60 degrees along the circle formed by the main body member. The latter arrangement is adapted to be utilized on 12 inch diameter columns, while for larger size columns, ranging in size from 18 to 48 inches in diameter, spaces are adapted to be provided, additionally, at every 22½ degree intervals along the aforementioned circle. The size of each of the spaces is such as to accept steel bars ranging in size from #5 to #8.

Hook-like formations are formed adjacent each of the side edges of substantially all of the interior projections. The spacer member is intended to be formed as an integral molding of high-density polystyrene.

The spacer member is adapted to be utilized by inserting each of the desired number and size of reinforcing bars into a respective space on the spacer in conformance with applicable design specifications. The bars are intended to be inserted into the spacer such that they are arranged longitudinally with respect to the main body member. Once the spacer has been placed at the desired longitudinal location along the length of the bars, each of the bars is tied into position within its respective space by wrapping wire around the bar and around an adjacent hook-like formation. After the proper number of spacer members have been applied to the bar, hoops may be tied around the bars to complete the assembly. The entire assembly is then adapted to be placed in the appropriate form, with the remote edges of the outer extensions abutting the inner surface of the form.

The spacer member successfully achieves proper and accurate spacing of the reinforcing bars, eliminating guesswork by field personnel, while preventing shifting of the bars when the concrete is being placed. The spacer member is uniquely designed to insure that the reinforcing bars, as well as the hoop steel, is maintained at least 1½ inches inside the face of the concrete.

BRIEF DESCRIPTION OF THE DRAWINGS

FIG. 1 is a top plan view of the spacer member of the present invention and showing in phantom the concrete form and several steel reinforcing bars;

FIG. 2 is a side sectional view of the spacer member depicted in FIG. 1 taken along line 2—2 and showing steel reinforcing bars in phantom;

FIG. 3 is an exploded fragmentary view taken of section 3 in FIG. 1;

DETAILED DESCRIPTION OF THE PREFERRED EMBODIMENT

Figure 4:
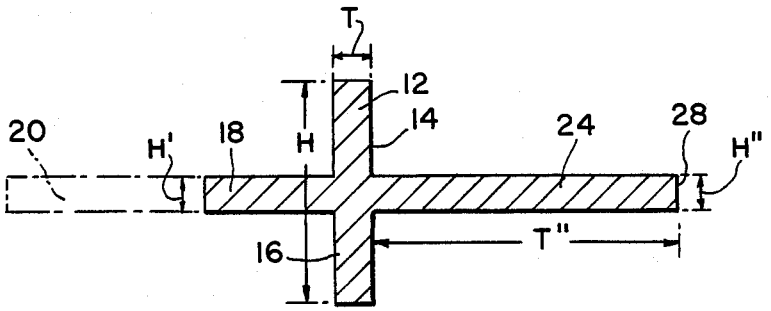
FIG. 4 is an exploded side sectional view of the spacer member depicted in FIG. 1 taken along line 4—4 of FIG. 1.
Figure 5:
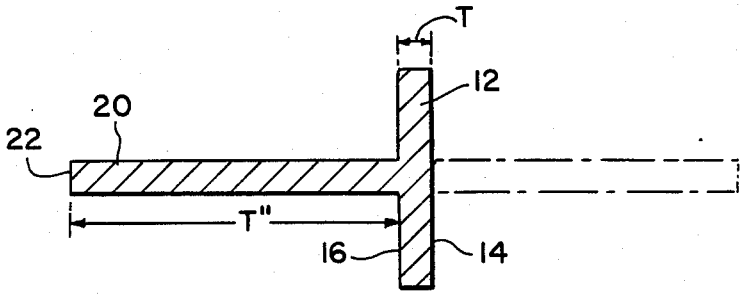
FIG. 5 is an exploded side sectional view of the spacer member depicted in FIG. 1 taken along line 5—5 of FIG. 1 but without the reinforcing bar.
Figure 6:
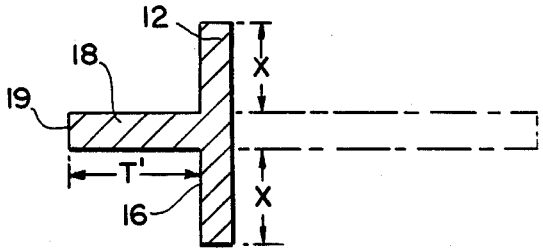
FIG. 6 is an exploded side sectional view of the spacer member depicted in FIG. 1 taken along line 6—6 of FIG. 1.

Referring to the drawings, and in particular to FIG. 1, the spacer member 10 of the present invention comprises a generally annular main body member 12 in the form of a ring. With reference to FIGS. 4–6, it can be seen that the main body member is formed, preferably, with a thickness T of ⅛ of an inch, and a vertical height H of ¾ of an inch. The main body member thus defines an interior vertical surface 14 and an exterior vertical surface 16.

The exterior vertical surface 16 of the main body member is interrupted by a continuous exterior circumferential projecting portion 18, which extends perpendicular to vertical surface 14. The projecting portion 18, which is best illustrated in FIGS. 1, 4 and 6, possesses a thickness T' of $\frac{3}{8}$ of an inch, as measured from its outer edge 19 to the exterior vertical surface 16, and a vertical height H' of $\frac{1}{8}$ of an inch. Thus, the exterior vertical surface 16 extends above and below the projecting portion 18 for a distance X, shown in FIG. 6, of 5/16 of an inch.

The projecting portion 18, as illustrated in FIG. 1, is interrupted by a plurality of outer extensions 20. With further reference to FIG. 5, it can be seen that each outer extension is integral and continuous with the projecting portion and, therefore: like the projecting portion 18, is formed with a height of $\frac{1}{8}$ of an inch. The thickness of each outer extension is such that, taken in conjunction with the thickness T' of the projecting portion, the thickness of each outer extension and the thickness of its adjacent, integral projecting portion together equals 1 $\frac{3}{4}$ inches. Since the preferred thickness T' of the projecting portion is $\frac{3}{8}$ of an inch, it follows that the preferred thickness, not separately identified, of each outer extension is 1 $\frac{3}{8}$ inches. The latter combined thicknesses T'' of an outer extension and the projecting portion is, as can be seen in FIG. 5, measured from the remote edge 22 of the outer extension to where the projecting portion intersects the exterior vertical surface 16 of the main body member 12.

The interior vertical surface 14 of the main body member 12 is provided with perpendicular, integral interior projections 24. Unlike the exterior projecting portion, however, the interior projections are not circumferentially continuous, but, as seen in FIG. 1, are in the form of discrete projections which are separated from each other by means of spaces 26. With reference to FIG. 4, each projection 24 preferably possesses a vertical height H'' of $\frac{1}{8}$ of an inch, and a thickness T'' of 1 inch, as measured from the remote edge 28 of the projection to where the projection intersects the interior vertical surface.

Referring again to FIG. 1, the size and arrangement of each projection is such that a space 26 having a depth D of 1 $\frac{1}{8}$ inches is located along the interior vertical surface at intervals of 22$\frac{1}{2}$ degrees along the circle formed by the circular main body member. The depth D is defined between side edges 30 of each projection, such that each of the 1 $\frac{1}{8}$ inch spaces is defined between the side edge of a first projection and a side edge of a second, next adjacent projection.

As most clearly depicted in FIGS. 1 and 3, a hook-like formation 32 is provided adjacent substantially all of the side edges 30, the purpose of which will be described further herein.

As previously noted, and with reference to FIG. 1, a space 26 is provided along the main body member at every 22$\frac{1}{2}$ degree location of the circle defined by the main body member. Additionally, a space 26 is similarly located at every 45 degree interval along the circle formed by the main body member and at every 60 degree interval along the circle formed by the main body member. In order to achieve the latter spacing, the depth D' of each interior projection is not the same. Rather, it is necessary to provide projections 34 and 36, which have a depth that is less than the depth D'. In the case of projections 36, the depth of which is quite small, only one of the side edges 30 need be provided with a hook member 32.

The spacer member is adapted to be utilized for round column members ranging in diameter from 12 to 48 inches. The spacer member, including the 22$\frac{1}{2}$, 45 and 60 degree spacing would be the same for each application, except that in the case of a 12 inch diameter column, the spaces disposed at 22$\frac{1}{2}$ degree intervals would be eliminated. The spacer member for a smaller size column, such as a 12 inch diameter column, would thus be provided with spaces 26 located along the vertical interior surface of the main body member at spacing intervals of only 45 and 60 degrees. In all cases, the spacer member is preferably formed as an integral molding of high-density polystyrene.

The steel reinforcing bars 38 are adapted to be manually assembled to the spacer in the field on a bench or otherwise separated from the concrete form. The requisite spacing scheme, as well as the size of the reinforcing bars for a particular column member, will depend upon design parameters, such as wind loading, etc., established by the architect or engineer. Regardless of the specific spacing adopted, the field personnel need only insert the proper size steel bars 38 into the spaces 26 which correspond to the intervals specified by the designer. Obviously, the spacer member can be color coded or otherwise marked to visibly indicate to field personnel the proper orientations.

Once a steel bar is placed into a space 26, as shown in FIGS. 1 and 3, it is adapted to be securely tied in position within the space, between the side edges 30 of adjacent projections 24, by means of wire 40 or other suitable tying means. Steel bars smaller in size than #8 are intended to be pulled into a corner in the space 26, while #8 steel bars would fill the entire space. As can be seen most clearly in FIG. 3, the wire is intended to be wrapped around one of the adjacent hook members 32 and around the bar 38, and tied around the main body member, so as to achieve a very tight and secure connection. The depth D of each space 26, previously noted as being 1$\frac{1}{8}$ inches, is uniquely suitable for accepting steel reinforcement ranging in size from #5 to #8 steel bars.

After the steel reinforcing bars have been tied to the spacer member, one or more hoops (not shown) may be tied around the arrangement of vertical bars to further maintain correct orientation of the bars. The entire assembly is adapted to then be disposed within a wood form 42 for the column member, as illustrated in FIG. 1, wherein it is stood over dowels which project upwardly from the foundation or slab upon which the column is to stand. Preferably, a plurality of spacer members are provided along the vertical length of the reinforcing bars; a spacer being provided for the bars at the bottom of the column about 3 inches above the dowels, then 4 inches on center along the vertical length of the column to within 2 inches of the top of the column. As noted above, the spacer members and rods are assembled together on a bench or otherwise similarly isolated from the form, the rods are tied into position within the appropriate spaces 26, hoops are provided around the assembly and the complete assembly is positioned within the form.

As can be seen in FIG. 1, the remote edges 22 of the outer extensions 20 are adapted to abut the inside surface of the wood form 42. Because the spacer member and reinforcing rods are tied together to form a secure and rigid unit, the spacer member need not be secured to the form in any manner. From the particulars previously discussed, it is apparent that the distance from the remote edge 22 of each outer extension 20 to the interior vertical surface 14 of the main body member 12 is $1\frac{7}{8}$ inches. This dimension is deemed to be important as it ensures that all of the steel utilized in the reinforcement assembly is located at least $1\frac{1}{2}$ inches inside the interior surface 44 of the form and, hence, $1\frac{1}{2}$ inches inside the face of the concrete. Not only are the steel bars themselves maintained the necessary distance inside the form and are, in fact, positioned $1\frac{7}{8}$ inches inside the form, but the hoop wiring (not shown), which will normally be provided around the arranged grouping of reinforcing bars, will also be maintained inside the form the $1\frac{1}{2}$ minimum distance considered necessary to prevent oxidation. The hoops, when assembled around the bars, will generally extend $\frac{3}{8}$ of an inch from the interior vertical surface 14 of the main body member 12, to the outer edge 19 of the projecting portion 18. Thus, the outer extensions 20 account for the hoop wire being positioned $1\frac{1}{2}$ inches inside the inside surface of the form and, therefore, $1\frac{1}{2}$ inches inside the face of the concrete. Obviously, outer extensions 20 may be lengthened in order to accommodate even more stringent design standards, as warranted.

Although the foregoing invention has been described in connection with a preferred embodiment, it is to be understood that various modifications which may be apparent to one skilled in the art may be made to the detailed description without departing form the spirit and scope of the invention as defined by the appended claims.

What is claimed is:

1. A spacer member for locating steel reinforcing bars in a structural member having a generally circular cross-section comprising a generally circular main body member, said main body member having a vertical interior surface and a vertical exterior surface, a plurality of outer extensions integral with and projecting perpendicularly from approximately the mid-point of said vertical exterior surface, each of said outer extensions having a remote vertical edge, a plurality of interior projections integral with and projecting perpendicularly from approximately the mid-point of said vertical interior surface, each of said interior projections being substantially continuous and circumscribed by an inner edge and a pair of side edges, each of said interior projections being separated from a next adjacent interior projection by a space along said vertical interior surface, said space being defined between the side edges of adjacent interior projections, each of said spaces being adapted to accommodate a reinforcing bar, hook-like formations provided proximate said side edges of substantially all of said interior projections for engaging wire securing means to be wrapped therearound and around said reinforcing bars for securing said reinforcing bars within said spaces, said spaces being located along said vertical interior surface at intervals of around every 45 degrees and every 60 degrees along the circle formed by the main body member.

2. The spacer member recited in claim 1 wherein said structural member is formed by pouring concrete into a form, said remote edges of said outer extensions being adapted to abut said form.

3. The spacer member recited in claim 1 wherein the distance from each of said remote edges to said vertical interior surface is at least $1\frac{7}{8}$ inches.

4. The spacer member recited in claim 1 wherein the depth of each of said spaces, as defined by the distance between said side edges of said adjacent interior projections, is around $1\frac{1}{8}$ inches.

5. The spacer member recited in claim 1 further comprising spaces located along said vertical interior surface at intervals of around every $22\frac{1}{2}$ degrees of the circle formed by the main body member.

6. The spacer member recited in claim 1 wherein said main body member, said outer extensions, said interior projections and said hook-like formations are formed as an integral molding.

7. The spacer recited in claim 6 wherein said spacer member is formed of high-density polystyrene.

8. A spacer member for locating reinforcing bars in a concrete structural member having a generally circular cross-section and being formed by pouring concrete into a form having a bottom and a top and into the bottom of which projects a plurality of dowels, said spacer member comprising a circular main body section in the form of a ring and having a vertical interior surface and a vertical exterior surface, a plurality of outer extensions integral with and projecting perpendicularly from approximately the mid-point of said vertical exterior surface, each of said outer extensions having a remote vertical edge adapted to abut said form, a plurality of interior projections integral with and projecting perpendicularly from approximately the mid-point of said vertical interior surface, each of said interior projections being substantially continuous and circumscribed by an inner edge and a pair of side edges, each of said interior projections being separated from a next adjacent interior projection by a space along said vertical interior surface, said space being defined between the side edges of next adjacent interior projections, each of said spaces being adapted to receive a steel reinforcing bar ranging in size from #5 to #8 and disposed longitudinally with respect to said spacer member, hook-like formations provided proximate said side edges of substantially all of said interior projections for engaging wire securing means to be wrapped around said bar and around adjacent hook-like formations for securing said bars within said spaces, said spaces being located along said vertical interior surface at intervals of around every 45 degrees and every 60 degrees along the circle formed by the main body member, the distance measured from each of said remote edges of said outer extensions to said vertical interior surface being at least $1\frac{7}{8}$ inches, a spacer member being adapted to be located in said bottom of said form around 3 inches above said dowels, around 4 inches on center thereafter to within around 2 inches of said top of said form, said spacer member being adapted to positively locate said reinforcing bars and to prevent shifting of said reinforcing bars when said concrete is poured into said form.

9. The spacer member recited in claim 8 wherein the depth of each of said spaces, as defined by the distance between said side edges of said next adjacent interior projections, is around $1\frac{1}{8}$ inches.

10. The spacer member recited in claim 8 further comprising spaces located along said vertical interior surface at intervals of around every $22\frac{1}{2}$ degrees along the circle formed by the main body member.

11. The spacer member recited in claim 8 wherein said main body member, said outer extensions, said interior projections and said hook-like formations are formed as an integral molding.

12. The spacer member recited in claim 11 wherein said spacer member is formed of high-density polystyrene.

13. A method of using a spacer member for locating steel reinforcing bars in a concrete structural member having a generally circular cross-section and being formed by pouring concrete into a form having a bottom and a top and into the bottom of which projects a plurality of dowels, said spacer member being characterized by a circular main body section having a vertical exterior surface from which projects a plurality of outer extensions having remote edges, a vertical interior surface from which projects a plurality of interior projections, each of said interior projections having a pair of side edges, each of said interior projections being separated from a next adjacent interior projection by a space along said vertical interior surface, hook-like formations provided proximate said side edges of substantially all of said interior projections, said method comprising the steps of:

manually inserting each of a desired number of said reinforcing bars into a respective one of a desired space of a first of said spacer members;

locating said first spacer member at a longitudinal location along said reinforcing bars which corresponds to the desired distance for said first spacer member above said bottom of said form;

tying each of said reinforcing bars to said first spacer member in its respective one of said spaces by wrapping securing means around each of said reinforcing bars and around a hook-like formation of a next adjacent interior projection;

inserting said reinforcing bars into a second one of said spacer members, locating said second spacer member longitudinally along said reinforcing bars and tying each of said reinforcing bars to said second spacer member;

inserting, locating and tying said reinforcing bars with respect to additional numbers of said spacer members;

tying at least one wire hoop around the plurality of reinforcing bars so as to form a complete assembly; and placing said complete assembly within said form whereby said remote edges of said outer extensions abut said form.

14. The method recited in claim 13 wherein said longitudinal location for said first spacer member corresponds to a distance which is 3 inches above said dowels projecting into said bottom of said form.

15. The method recited in claim 13 wherein said second spacer member is located longitudinally along said reinforcing bars around 4 inches on center, above said first spacer member.

16. The method recited in claim 13 wherein said additional numbers of said spacer members are located longitudinally along said reinforcing bars at a spacing of around 4 inches, on center, with respect to a next adjacent spacer member to a longitudinal location along said reinforcing bars corresponding to within 2 inches of said top of said form.

* * * * *